US008840049B2

(12) United States Patent
Kouketsu et al.

(10) Patent No.: US 8,840,049 B2
(45) Date of Patent: Sep. 23, 2014

(54) LIQUID EJECTING APPARATUS

(75) Inventors: Masayuki Kouketsu, Komaki (JP); Hiroshi Itafuji, Komaki (JP)

(73) Assignee: CKD Corporation, Komaki-shi, Aichi (JP)

( * ) Notice: Subject to any disclaimer, the term of this patent is extended or adjusted under 35 U.S.C. 154(b) by 479 days.

(21) Appl. No.: 13/264,742

(22) PCT Filed: Apr. 16, 2010

(86) PCT No.: PCT/JP2010/056871

§ 371 (c)(1), (2), (4) Date: Oct. 14, 2011

(87) PCT Pub. No.: WO2010/119961

PCT Pub. Date: Oct. 21, 2010

(65) Prior Publication Data

US 2012/0024989 A1 Feb. 2, 2012

(30) Foreign Application Priority Data

Apr. 16, 2009 (JP) ..... 2009-099669

(51) Int. Cl.

| | |
|---|---|
| ***B05C 1/02*** | (2006.01) |
| ***B05C 5/02*** | (2006.01) |
| ***B05B 1/04*** | (2006.01) |
| *B05B 1/30* | (2006.01) |

(52) U.S. Cl.

CPC ..... *B05C 5/0283* (2013.01); *B05C 5/0258* (2013.01); *B05C 5/0225* (2013.01); *B05B 1/044* (2013.01); *B05B 1/3013* (2013.01)

USPC ..... 239/595; 239/583; 239/592; 239/597; 118/710; 118/711

(58) Field of Classification Search

CPC ..... B05C 1/025; B05C 1/027; B05C 1/0225; B05C 1/0258

USPC ..... 239/568, 583, 592, 595, 596, 597, 601; 118/710, 711

See application file for complete search history.

(56) References Cited

U.S. PATENT DOCUMENTS 3,630,453 A * 12/1971 Lane et al. ..... 239/437
3,938,468 A * 2/1976 Kirschner ..... 118/63

(Continued)

FOREIGN PATENT DOCUMENTS

JP 46-14776 4/1971
JP 56-138571 10/1981

(Continued)

OTHER PUBLICATIONS

Search Report dated Jul. 20, 2010 from International Application No. PCT/JP2010/056871.

*Primary Examiner* — Ryan Reis
(74) *Attorney, Agent, or Firm* — Beyer Law Group LLP

(57) ABSTRACT

A liquid ejecting apparatus having a storage portion (20) for storing a treatment liquid, a slit-shaped opening portion (41) for ejecting the treatment liquid, and a connecting passage (42) that has a slit-shaped cross-section and connects the storage portion (20) to the slit-shaped opening portion (41) includes: a valve body portion (50) that is provided in the storage portion (20) to cover the connecting passage (42), and forms a gap (22) together with a lower wall (43) of the storage portion (20) so that the treatment liquid is caused to flow into the connecting passage (42) through the gap (22); a first curved surface portion (44*a*) that smoothly connects a surface of the lower wall (43) of the storage portion (20) to an inner wall surface (42*a*) of the connecting passage (42); and a second curved surface portion (51*a*) that is provided on the valve body portion (50) so as to project to an identical side to the first curved surface portion (44*a*). With this constitution, air bubbles can be prevented from intermixing with the treatment liquid ejected from the slit-shaped opening portion (41).

20 Claims, 12 Drawing Sheets

(56) References Cited

U.S. PATENT DOCUMENTS

| | | | | |
|---|---|---|---|---|
| 3,942,723 | A * | 3/1976 | Langdon | 239/135 |
| 7,204,432 | B2 * | 4/2007 | Yon | 239/284.2 |
| 7,604,842 | B2 * | 10/2009 | Shida et al. | 427/356 |

FOREIGN PATENT DOCUMENTS

| | | |
|---|---|---|
| JP | 2002-361151 | 12/2002 |
| JP | 2003-24854 | 1/2003 |
| JP | 2005-144376 | 6/2005 |

* cited by examiner

LIQUID EJECTING APPARATUS

TECHNICAL FIELD

The present invention relates to an apparatus that ejects a liquid through a slit-shaped opening portion.

BACKGROUND ART

In an example of this type of apparatus (see Patent Document 1), a resist liquid supply port is provided in both lengthwise direction end portions of a slit nozzle having a slit-shaped opening, and an air venting hole is provided in a manifold for storing the resist liquid temporarily in a higher position than the resist liquid supply port. In the apparatus described in Patent Document 1, the resist liquid is supplied to the manifold from the supply port and ejected through the slit-shaped opening while air bubbles intermixed into the resist liquid are discharged through the air venting hole.

Patent Document 1: Japanese Patent Application Publication No. 2005-144376

Incidentally, in the apparatus described in Patent Document 1, the resist liquid is transmitted from the manifold to the slit-shaped opening through a connecting passage that has a similarly shaped cross-section to the slit-shaped opening and connects the manifold to the opening. Although it is possible with the apparatus described in Patent Document 1 to prevent air bubbles intermixed into the resist liquid from traveling through the manifold toward the connecting passage, air bubbles may intermix with the resist liquid as the resist liquid flows into the connecting passage from the manifold.

By ejecting the resist liquid through the slit-shaped opening in advance before the resist liquid is applied, the air bubbles may be discharged together with the resist liquid, but in this case, an extra process is required and the resist liquid is consumed wastefully.

DISCLOSURE OF THE INVENTION

The present invention has been designed in consideration of the current circumstances described above, and an object thereof is to provide a liquid ejecting apparatus with which air bubbles can be prevented from intermixing with a liquid ejected through a slit-shaped opening portion without ejecting the liquid in advance in order to remove air bubbles therefrom.

To achieve the object described above, a first aspect of the teaching is a liquid ejecting apparatus having a storage portion for storing a liquid, a slit-shaped opening portion for ejecting the liquid, and a connecting passage that has a slit-shaped cross-section and connects the storage portion to the slit-shaped opening portion, including: a flow varying member that is provided in the storage portion to cover a flow passage cross-section of the connecting passage and forms a gap together with an inner wall of the storage portion so that the liquid is caused to flow into the connecting passage through the gap; a first curved surface portion that projects to the storage portion side and smoothly connects an inner wall surface of the storage portion to an inner wall surface of the connecting passage; and a second curved surface portion that is provided on the flow varying member to project to an identical side to the first curved surface portion and oppose the first curved surface portion.

According to the above constitution, the liquid stored in the storage portion is ejected through the slit-shaped opening portion via the connecting passage. Here, a flow of the liquid from the storage portion toward the connecting passage is blocked by the flow varying member provided in the storage portion to cover the flow passage cross-section of the connecting passage, and therefore the liquid flows into the connecting passage through the gap between the inner wall of the storage portion and the flow varying member. The liquid that flows into the connecting passage flows along the first curved surface portion, which projects to the storage portion side and smoothly connects the inner wall surface of the storage portion to the inner wall surface of the connecting passage, and the second curved surface portion, which is provided on the flow varying member so as to project to an identical side to the first curved surface portion and oppose the first curved surface portion, through a gap between the first curved surface portion and the second curved surface portion. Therefore, the liquid flow is led in the direction of the inner wall surface of the connecting passage, and the liquid flow is prevented from separating from the inner wall surface of the connecting passage. Hence, when the liquid flows into the connecting passage from the storage portion, air sandwiched between the liquid flow and the inner wall surface of the connecting passage can be prevented from intermingling with the liquid. As a result, air bubbles can be prevented from intermixing with the liquid ejected through the slit-shaped opening portion without processing to eject the liquid in advance in order to remove air bubbles therefrom.

In a second aspect of the teaching pertaining to the first aspect, a radius of curvature of the second curved surface portion is set to be larger than a radius of curvature of the first curved surface portion, and therefore the second curved surface portion gradually separates from the first curved surface portion toward a downstream side of the liquid. Hence, the liquid flowing along the second curved surface portion, while being led in the direction of the inner wall surface of the connecting passage, spreads out in a direction heading away from the inner wall surface of the connecting passage, or in other words gradually in a center direction of the connecting passage, toward the downstream side. As a result, unevenness in a flow rate of the liquid in the flow passage cross-section of the connecting passage can be suppressed, and the liquid can be ejected more evenly through the slit-shaped opening portion.

In a third aspect of the teaching pertaining to the first or second aspect, a length of the second curved surface portion is set to be greater than a length of the first curved surface portion in a flow direction of the liquid, and therefore the liquid flow can be led in the direction of the inner wall surface of the connecting passage by the second curved surface portion over a wider range.

In a fourth aspect pertaining to any of the first to third aspects, the second curved surface portion is provided to extend further toward a downstream side than the first curved surface portion in a flow direction of the liquid, and therefore the liquid flowing along the first curved surface portion can be led further downstream in the direction of the inner wall surface of the connecting passage by the second curved surface portion.

In a fifth aspect pertaining to any of the first to fourth aspects, an inner wall of the storage portion and the flow varying member are capable of relative movement, and the gap between the inner wall of the storage portion and the flow varying member can be sealed on the basis of the relative movement. Therefore, ejection of the liquid can be stopped even when pressure for causing the liquid to flow into the connecting passage is generated.

In a sixth aspect pertaining to any of the first to fifth aspects, the connecting passage is connected to a lower portion of the storage portion, and the gap between the inner wall of the storage portion and the flow varying member is disposed horizontally, whereby the liquid is ejected from the slit-shaped opening portion under a pressure generated by a weight of the liquid itself.

When the liquid stored in the storage portion is pressurized and ejected, the pressure of the liquid is distributed, and as a result, the liquid may be ejected from the slit-shaped opening portion unevenly.

With regard to this point, according to the above constitution, the connecting passage is connected to the lower portion of the storage portion and the gap between the inner wall of the storage portion and the flow varying member is disposed horizontally, and therefore the pressure generated by the weight of the liquid stored in the storage portion is uniform throughout the gap between the inner wall of the storage portion and the flow varying member. Hence, when the liquid is to be ejected from the slit-shaped opening portion under the pressure generated by the weight of the liquid itself, the liquid can be transmitted into the connecting passage through the gap between the inner wall of the storage portion and the flow varying member at a uniform pressure. As a result, the liquid can be ejected through the slit-shaped opening portion more evenly.

In particular, in the sixth aspect, all of the liquid stored in the storage portion is ejected through the slit-shaped opening portion, and therefore the liquid can be transmitted to the connecting passage through the gap between the inner wall of the storage portion and the flow varying member at a uniform pressure until ejection of the liquid is complete. Moreover, air bubble generation due to pressure variation in the liquid occurring when ejection of the liquid is halted midway can be avoided.

In a seventh aspect pertaining to the sixth aspect, the first curved surface portion is provided in a loop shape around the inner wall surface of the connecting passage having the slit-shaped cross-section, and the inner wall of the storage portion and the flow varying member are capable of relative movement, and on the basis of the relative movement, the gap between the inner wall of the storage portion and the flow varying member can be sealed in a loop shape in an equidistant position from the first curved surface portion.

According to the above constitution, similarly to the sixth invention, the pressure generated by the weight of the liquid stored in the storage portion is uniform throughout the gap between the inner wall of the storage portion and the flow varying member, and therefore the liquid can be transmitted to the connecting passage through the gap at a uniform pressure. Here, the first curved surface portion is provided in a loop shape around the inner wall surface of the connecting passage having the slit-shaped cross-section, and the gap between the inner wall of the storage portion and the flow varying member is sealed in a loop shape in an equidistant position from the first curved surface portion. Therefore, when liquid ejection begins from a condition in which the gap is sealed on the basis of relative movement of the inner wall of the storage portion and the flow varying member, the liquid is transmitted evenly to the first curved surface portion through the loop-shaped gap. Hence, the liquid flows evenly along the inner wall surface of the connecting passage, and as a result, the liquid can be ejected through the slit-shaped opening portion more evenly.

In an eighth aspect pertaining to the sixth or seventh aspect, the inner wall surface of the storage portion is inclined so as to become gradually lower toward the connecting passage. Therefore, when the liquid is to be ejected through the slit-shaped opening portion under the pressure generated by the weight of the liquid itself, the liquid stored in the storage portion gathers in the connecting passage due to gravity. Asa result, the liquid stored in the storage portion can be ejected fully.

BEST MODES FOR CARRYING OUT THE INVENTION

A specific embodiment of a liquid ejecting apparatus for ejecting a liquid such as a treatment liquid used in etching or plating through a slit-shaped opening will be described below with reference to the drawings.

Figure 1:
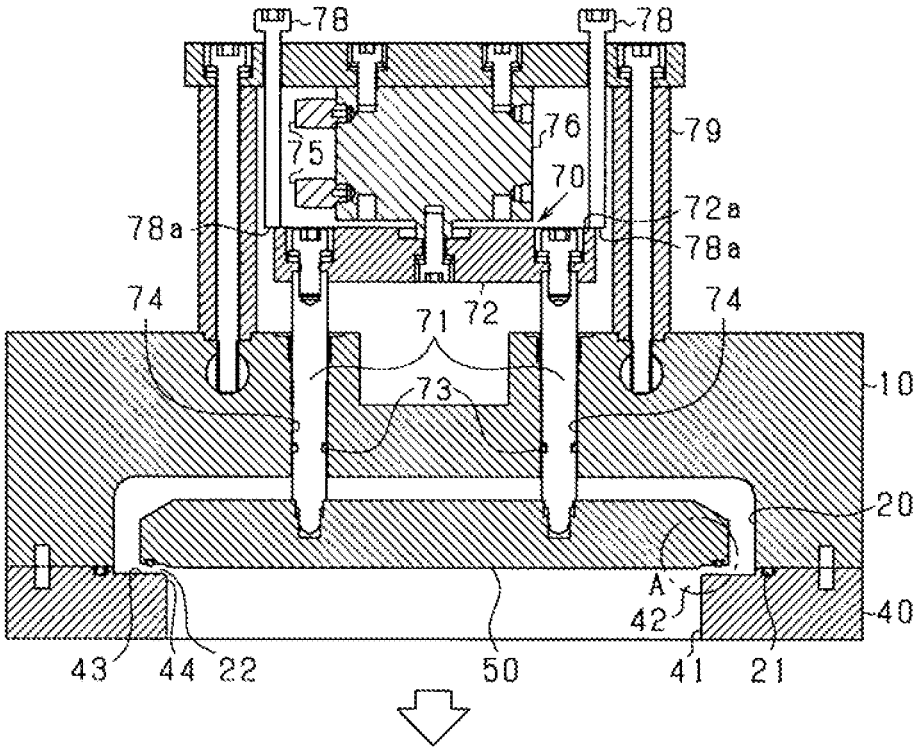
FIG. 1 is a sectional view showing an embodiment of a liquid ejecting apparatus.
Figure 2:
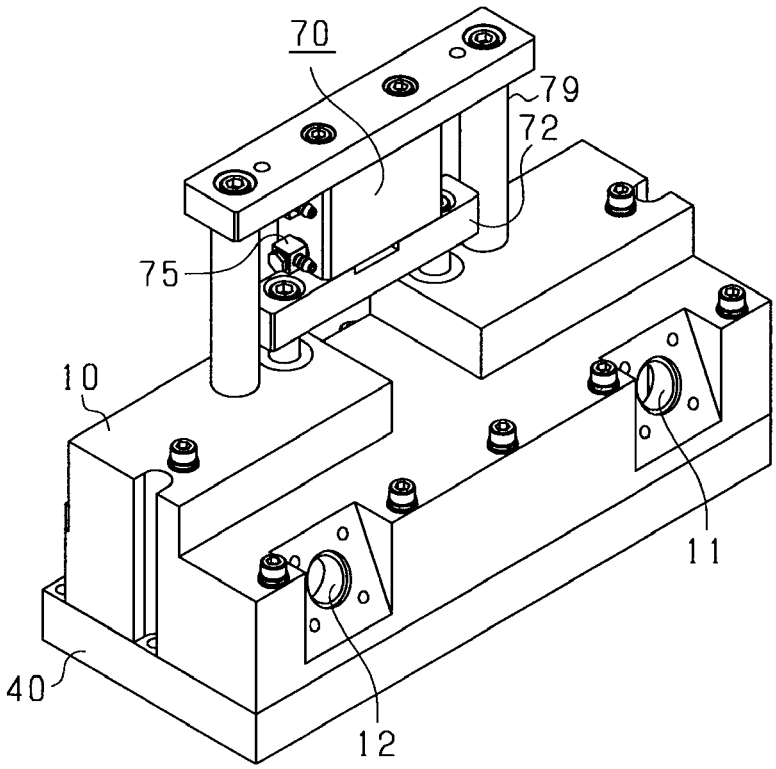
FIG. 2 is a perspective view showing the liquid ejecting apparatus.

As shown in FIGS. 1 and 2, the liquid ejecting apparatus includes a first main body 10 and a second main body 40 having a liquid storage portion 20 in an interior thereof, a valve body 50 (, or a flow varying member) for varying a flow of liquid from the interior of the storage portion 20 toward a slit-shaped opening 41, and a driving portion 70 that generates relative movement between a bottom-wall 43 (, or a part of an inner wall of the storage portion 20) and the valve body 50. Note that the liquid ejecting apparatus may be used when fixed or while being moved.

The main body is formed by coupling the first main body 10 to the second main body 40. A cavity constituting the liquid storage portion 20 is provided in the interior of the main bodies 10 and 40. The storage portion 20 is formed by providing a recessed portion in the first main body 10 and then attaching the second main body 40 to the first main body 10 so as to cover the recessed portion. A seal 21 is provided between the first main body 10 and the second main body 40 to prevent a treatment liquid in the storage portion 20 from leaking out between the first main body 10 and the second main body 40. Note that the liquid stored in the storage portion 20 and ejected through the slit-shaped opening 41 is not limited to a treatment liquid used in etching and plating, and another liquid, such as resist used in a semiconductor manufacturing process, may be employed instead.

Figure 3:
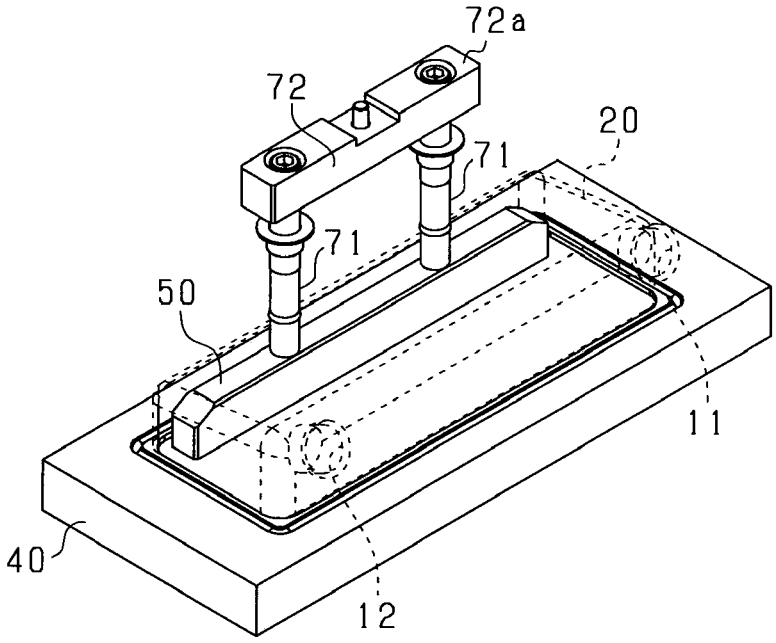
FIG. 3 is a perspective view showing a storage portion and a valve body portion of the liquid ejecting apparatus shown in FIG. 2.

Referring also to FIG. 3, the storage portion 20 will be described. As shown by dotted lines in FIG. 3, the storage portion 20 is formed in a substantially rectangular parallelepiped shape. A capacity of the storage portion 20 is set so that an amount of treatment liquid ejected by the liquid ejecting apparatus in a single process can be stored therein. In other words, the capacity of the storage portion 20 is set to be equal to or slightly larger than a sum of a volume of treatment liquid ejected in a single process and a volume of members such as the valve body 50 housed in the storage portion 20. Hence, the treatment liquid is stored in the storage portion 20 of the liquid ejecting apparatus in the amount used in a single process such that all of the treatment liquid stored in the storage portion 20 is ejected in a single process. More specifically, the capacity of the storage portion 20 is set at several hundred ml.

The storage portion 20 communicates with the exterior of the first main body 10 via a supply port 11 and a ventilation port 12 provided in the first main body 10. A supply passage for supplying the treatment liquid to the storage portion 20 is connected to the supply port 11. A ventilation passage for allowing air to flow into and out of the storage portion 20 is connected to the ventilation port 12. Accordingly, when the treatment liquid is supplied into the storage portion 20 through the supply port 11, air flows out of the storage portion 20 through the ventilation port 12. Further, when the treatment liquid in the storage portion 20 is ejected through the slit-shaped opening 41, air flows into the storage portion 20 through the ventilation port 12. As a result, the treatment liquid can be supplied to the storage portion 20 and discharged from the storage portion 20 smoothly. Note that the ventilation passage may be omitted and the ventilation port 12 may be open to the atmosphere.

Figure 4:
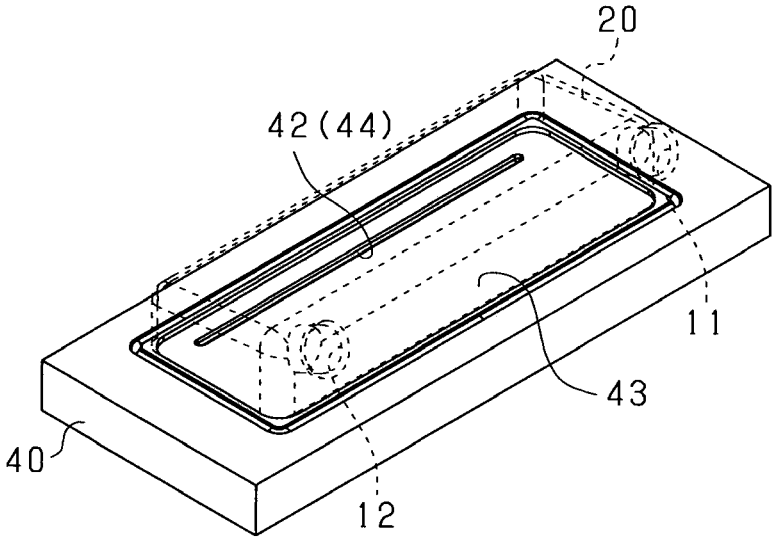
FIG. 4 is a perspective view showing the storage portion and a connecting passage of the liquid ejecting apparatus shown in FIG. 2.

Referring also to FIG. 4, from which the valve body 50 has been omitted, a connecting passage 42 provided in the second main body 40 will be described. The connecting passage 42 has a slit-shaped cross-section and connects the storage portion 20 to the slit-shaped opening 41 (see FIG. 1). The connecting passage 42 is connected to a lower portion of the storage portion 20, and opens onto the bottom-wall 43. In other words, an upper end portion of the connecting passage 42 serves as an opening 44 of the connecting passage 42 opening onto the storage portion 20. Hence, due to the action of gravity, the treatment liquid stored in the storage portion 20 flows into the connecting passage 42 opening onto the lower portion of the storage portion 20. Here, a surface of the bottom-wall 43 of the storage portion 20 is formed to be flat, and this surface of the bottom-wall 43 is disposed horizontally. Therefore, the treatment liquid stored in the storage portion 20 flows into the connecting passage 42 substantially entirely without accumulating in the storage portion 20.

The connecting passage 42 is formed to penetrate the second main body 40, and a cross-section thereof has an identical shape and identical dimensions to the slit-shaped opening 41. In other words, an end portion of the connecting passage 42 constitutes the slit-shaped opening 41, i.e. a liquid ejection port. A flow passage cross-section of the connecting passage 42 and the slit-shaped opening 41 are formed with a constant short side length (slit width). More specifically, the short side length (the slit width) of the flow passage cross-section of the connecting passage 42 and the slit-shaped opening 41 are set at several mm.

An opening surface of the slit-shaped opening 41 is disposed horizontally such that the opening 41 opens vertically downward. The connecting passage 42 connected respectively to the storage portion 20 and the opening 41 is disposed to extend in a vertical direction. More specifically, an inner wall surface of the connecting passage 42 is provided to extend in the vertical direction. Hence, the treatment liquid stored in the storage portion 20 is caused to flow downward through the connecting passage 42 by pressure generated under its own weight, and then ejected through the slit-shaped opening 41. The short side length (the slit width) of the flow passage cross-section of the connecting passage 42 is set at several mm, i.e. set to be comparatively large. Therefore, even when a liquid having a relatively high viscosity, such as resist, is used as the liquid, the liquid can be ejected through the slit-shaped opening 41 via the connecting passage 42 by the pressure generated under the weight of the liquid.

As shown in FIGS. 1 and 3, the flow varying member (the valve body 50) is housed in the storage portion 20 to cover the flow passage cross-section of the connecting passage 42, and forms a gap 22 together with the inner wall (the bottom-wall 43) of the storage portion 20 so that the treatment liquid is caused to flow into the connecting passage 42 through the gap 22. The valve body 50 is provided in the storage portion 20 so as to cover the flow passage cross-section of the connecting passage 42, or in other words the opening 44 of the connecting passage 42 opening onto the storage portion 20. Hence, a flow of the treatment liquid from the storage portion 20 toward the connecting passage 42 is blocked by the valve body 50 such that the treatment liquid is prevented from flowing directly into the connecting passage 42. Accordingly, the treatment liquid stored in the storage portion 20 flows into the connecting passage 42 through the gap 22 between the valve body 50 and the bottom-wall 43 serving as the inner wall of the storage portion 20. The gap 22 is provided to surround the opening 44 and disposed horizontally. Therefore, the pressure generated by the weight of the treatment liquid stored in the storage portion 20 is uniform throughout the gap 22 provided to surround the opening 44.

The bottom-wall 43 of the storage portion 20 and the valve body 50 are provided to be capable of relative movement, and on the basis of this relative movement, the bottom-wall 43 and the valve body 50 are sealed. In other words, a flow rate of the treatment liquid flowing into the connecting passage 42 through the gap 22 is adjusted by adjusting a width of the gap 22 on the basis of the relative movement between the bottom-wall 43 of the storage portion 20 and the valve body 50, and when the width of the gap 22 is set at zero, the bottom-wall 43 and the valve body 50 are sealed. At this time, the bottom-wall 43 and the valve body 50 are sealed in a loop shape so that the width of the gap 22 provided to surround the opening 44 reaches zero. Note that FIG. 1 shows a condition in which the treatment liquid flows into the connecting passage 42 through the gap 22, or in other words a condition in which the connecting passage 42 is opened by the valve body 50.

The valve body 50 is controlled from a condition in which a seal is formed between the bottom-wall 43 of the storage portion 20 and the valve body 50 to a condition in which the treatment liquid flows into the connecting passage 42 through the gap 22 on the basis of driving performed by the driving portion 70. More specifically, the valve body 50 is coupled to a piston serving (, or a movable portion) via a sliding portion 71 and a support portion 72 (, or a coupling portion). The sliding portion 71 is inserted to be capable of sliding into a through hole 74 provided in the first main body 10. The sliding portion 71 and the valve body 50 are provided on an extension of the connecting passage 42, or in other words above the opening 44 of the connecting passage 42. Accordingly, the valve body 50 approaches and separates from the opening 44 of the connecting passage 42 vertically. Here, the sliding portion 71 is provided in two locations apart from each other so that rotation of the valve body 50 about the sliding portion 71 can be suppressed. Note that the sliding portion 71 and the through hole 74 are sealed by a seal member 73. Thus, the treatment liquid in the storage portion 20 is prevented from flowing out to the exterior of the first main body 10 through the through hole 74.

The piston is housed in a cylinder 76 to be capable of reciprocating, and is driven to reciprocate on the basis of an operating pressure generated by air that is supplied and discharged through an operating port 75. More specifically, the piston is moved in a direction for causing the valve body 50 to approach the opening 44 of the connecting passage 42 via the support portion 72 and the sliding portion 71 by supplying air to one operating port 75. Further, the piston is moved in a direction for causing the valve body 50 to separate from the opening 44 of the connecting passage 42 via the support portion 72 and the sliding portion 71 by supplying air to another operating port 75. As a result, the valve body 50 can be caused to both approach and separate from the opening 44 of the connecting passage 42 comparatively forcefully and quickly on the basis of the operating pressure generated by the air.

An adjustment screw 78 is provided to adjust the width of the gap 22 between the bottom-wall 43 of the storage portion 20 and the valve body 50 when the connecting passage 42 has been opened by the valve body 50 (see FIG. 1). The adjustment screw 78 adjusts a position of the valve body 50 when the connecting passage 42 has been opened by the valve body 50, or in other words a movement width of the valve body 50 from a condition in which the connecting passage 42 is closed to a condition in which the connecting passage 42 is open, by impinging on the support portion 72 coupled to the valve body 50. More specifically, a base 79 is coupled to the first main body 10, and the base 79 supports the cylinder 76, the support portion 72, the sliding portions 71, the valve body 50, and so on. The adjustment screw 78 is attached to the base 79 to be capable of advancing and withdrawing. By adjusting a screwing amount of the adjustment screw 78, a position of an end portion 78*a* of the adjustment screw 78, which impinges on an end surface 72*a* of the support portion 72, or in other words a distance from the end portion 78*a* of the adjustment screw 78 to the bottom-wall 43 of the storage portion 20, can be adjusted.

Figure 5A:
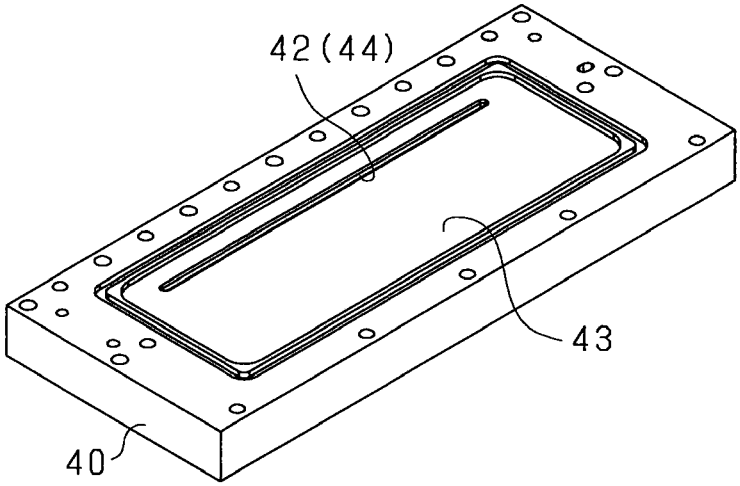
FIG. 5A is a perspective view showing a lower wall of the storage portion and an opening portion of the connecting passage.
Figure 5B:
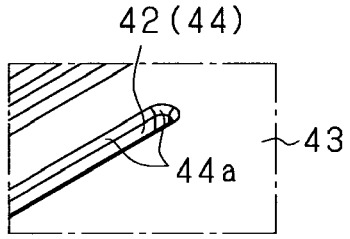
FIG. 5B is an enlarged perspective view of a first curved surface portion.
Figure 6A:
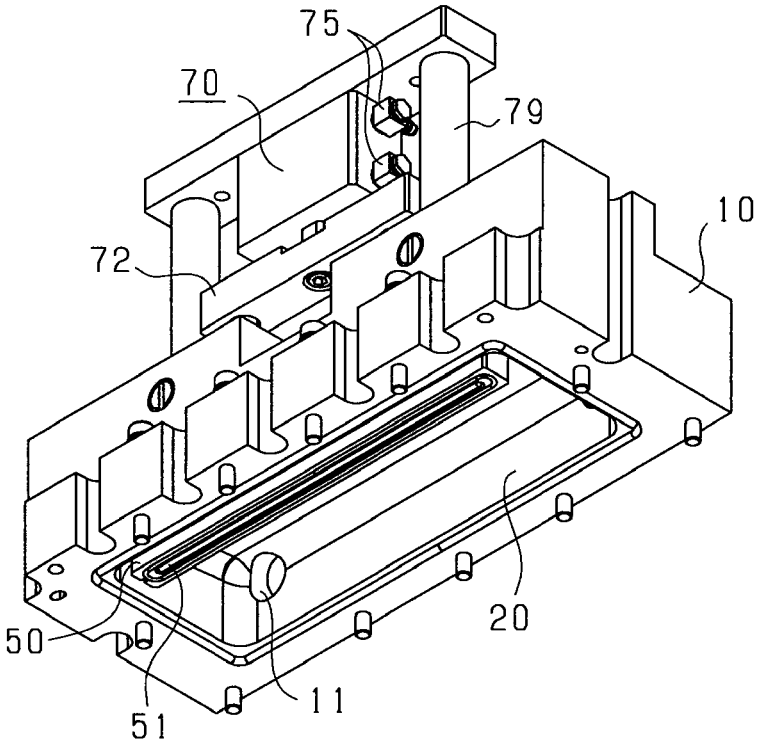
FIG. 6A is a perspective view showing the storage portion and the valve body portion of the liquid ejecting apparatus shown in FIG. 2 from below.
Figure 6B:
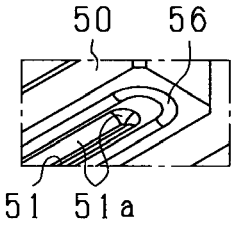
FIG. 6B is an enlarged perspective view of a second curved surface portion.
Figure 7:
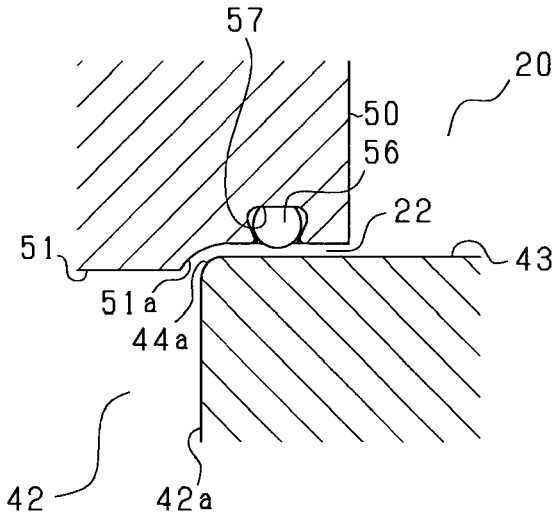
FIG. 7 is an enlarged sectional view of an A part shown in FIG. 1.

Next, referring to FIGS. 5 to 7, a first curved surface 44*a* that projects to the storage portion 20 side and smoothly connects the surface of the bottom-wall 43 of the storage portion 20 to the inner wall surface of the connecting passage 42, and a second curved surface 51*a* provided on the valve body 50 so as to project to an identical side to the first curved surface 44*a* and oppose the first curved portion 44*a*, will be described. Note that FIG. 5A is a perspective view showing the bottom-wall 43 of the storage portion 20 and the opening 44 of the connecting passage 42, while FIG. 5B is an enlarged perspective view of the first curved surface 44*a*. FIG. 6A is a perspective view showing the storage portion 20 and the valve body 50, while FIG. 6B is an enlarged perspective view of the second curved surface 51*a*. FIG. 7 is an enlarged sectional view of an A part shown in FIG. 1.

As shown in FIGS. 5A and 5B, the opening 44 of the connecting passage 42 is formed in a slit shape, and respective end portions thereof are semicircular. Hence, a peripheral edge of the opening 44 is shaped such that a pair of straight line portions are connected by arcs at either end. The first curved surface 44*a* is provided around the entire periphery of the opening 44 of the connecting passage 42. The first curved surface 44*a* smoothly connects the surface of the bottom-wall 43 of the storage portion 20 to the inner wall surface of the connecting passage 42, and projects to the storage portion 20 side. In other words, the surface of the bottom-wall 43 of the storage portion 20 and the inner wall surface of the connecting passage 42 are provided perpendicularly, and the first curved surface 44*a* connects these surfaces via a curved surface having a continuously varying gradient. The first curved surface 44*a* is formed continuously on both ends of the opening 44 of the connecting passage 42.

As shown in FIGS. 6A and 6B, a rib-shaped projecting portion 51 that projects in the direction of the connecting passage 42 is provided on the valve body 50, and the second curved surface 51*a* is constituted by a surface of the projecting portion 51. The projecting portion 51 extends along an extension direction of the valve body 50, or in other words an extension direction of the opening 44 of the connecting passage 42 formed in a slit shape. A seal 56 is provided on the valve body 50 to surround the projecting portion 51. In this embodiment, the seal 56 is an O ring. When the connecting passage 42 is closed by the valve body 50, a part of the projecting portion 51 is housed in the connecting passage 42. At this time, the seal 56 surrounds the opening 44 of the connecting passage 42 such that the bottom-wall 43 of the storage portion 20 and the valve body 50 are sealed in a loop shape.

As shown by the enlargement of the A part of FIG. 1 in FIG. 7, when the valve body 50 is driven in a direction for separating from the opening 44 of the connecting passage 42, or in other words from the first curved surface 44*a*, the seal 56 separates from the bottom-wall 43. In this condition, the first curved surface 44*a* and the second curved surface 51*a* are opposite each other. The second curved surface 51*a* projects to an identical side to the first curved surface 44*a* projecting to the storage portion 20 side and extends along the first curved surface 44*a*. Here, a radius of curvature of the second curved surface 51*a* is set to be larger than a radius of curvature of the first curved surface 44*a*. For example, the first curved surface 44*a* has a radius of curvature of 0.8 mm and the second curved surface 51*a* has a radius of curvature of 1.9 mm, whereby the radius of curvature of the second curved surface 51*a* is set to be approximately double the radius of curvature of the first curved surface 44*a*.

Respective furthest upstream side parts of the first curved surface 44*a* and the second curved surface 51*a* are disposed parallel to each other, or more specifically, both furthest upstream side parts are disposed horizontally. Therefore, an interval between the first curved surface 44*a* and the second curved surface 51*a* gradually widens toward a downstream side of the flow of the treatment liquid. Further, in this condition, an end portion of the projecting portion 51 of the valve body 50, or in other words a downstream side end portion of the second curved surface 51*a*, protrudes further into the connecting passage 42 than the surface of the bottom-wall 43. Hence, the treatment liquid flowing over the surface of the bottom-wall 43 of the storage portion 20 impinges on the second curved surface 51*a* while flowing into the connecting passage 42.

Furthermore, a length of the second curved surface 51*a* is set to be greater than a length of the first curved surface 44*a* in the treatment liquid flow direction. More specifically, the second curved surface 51*a* is provided to extend further to the downstream side than the first curved surface 44*a* in the treatment liquid flow direction. Hence, the treatment liquid flowing into the connecting passage 42 through the gap 22 is led by the second curved surface 51*a* in the direction of an inner wall surface 42*a* of the connecting passage 42 over a wider range toward the downstream side.

To stop the flow of treatment liquid into the connecting passage 42, the valve body 50 is driven to approach the opening 44 of the connecting passage 42, or in other words the first curved surface 44*a*. As a result, the seal 56 contacts the bottom-wall 43 of the storage portion 20 such that the bottom-wall 43 and the valve body 50 are sealed. Here, the seal 56 is provided in a loop shape in an equidistant position from the first curved surface 44*a*. Therefore, the valve body 50 seals the bottom-wall 43 of the storage portion 20 and the valve body 50 in a loop shape in an equidistant position from the first curved surface 44*a*.

Note that the seal 56 is inserted into a groove portion 57 formed as a so-called dovetail groove that is wider on a rear side than an opening side. Hence, even when the valve body 50 is driven such that the seal 56 contacts the bottom-wall 43 of the storage portion 20 repeatedly, the seal 56 is unlikely to become detached from the groove portion 57, and a seal characteristic between the bottom-wall 43 and the valve body 50 can be improved. Furthermore, the driving portion 70 drives the valve body 50 to reciprocate comparatively forcefully and quickly on the basis of the operating pressure generated by the air. Therefore, by driving the valve body 50 quickly from a condition in which the connecting passage 42 is closed by the valve body 50 such that the connecting passage 42 opens and the treatment liquid is ejected, and then reclosing the connecting passage 42, the seal 56 is easily maintained in a deformed shape generated upon contact with the bottom-wall 43. Hence, pressure variation in the treatment liquid caused by deformation of the seal 56 upon contact with the bottom-wall 43 can be suppressed, and as a result, air bubble generation in the treatment liquid can be suppressed.

Figure 8:
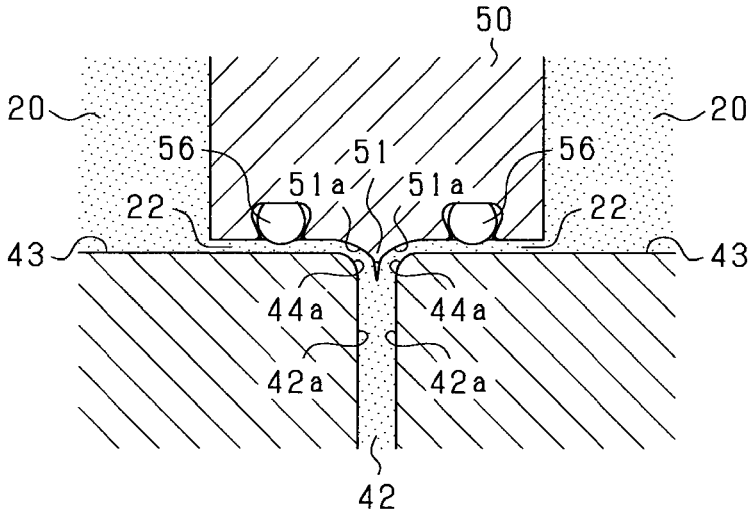
FIG. 8 is an enlarged sectional view showing the connecting passage from the side.

Actions of the liquid ejecting apparatus having this constitution will now be described with reference to FIG. 8. FIG. 8 is an enlarged sectional view showing the connecting passage 42 from the side in a condition where the treatment liquid flows into the connecting passage 42 from the storage portion 20.

First, in a condition prior to ejection of the treatment liquid by the liquid ejecting apparatus, an amount of treatment liquid used in a single process is stored in the storage portion 20, and the seal 56 seals the bottom-wall 43 of the storage portion 20 and the valve body 50. Here, the gap 22 is disposed horizontally, and therefore the pressure generated by the weight of the treatment liquid itself is uniform in the position sealed in a loop shape by the seal 56. Further, the treatment liquid is sealed in by the seal 56 in an equidistant position from the first curved surface 44*a*. From this condition, the valve body 50 is driven in the direction for separating from the opening 44 of the connecting passage 42, or in other words from the first curved surface 44*a*. When the end surface 72*a* of the support portion 72 coupled to the valve body 50 contacts the end portion 78*a* of the adjustment screw 78 described above, the valve body 50 is stopped, and as shown in FIG. 8, the gap 22 is formed between the bottom-wall 43 of the storage portion 20 and the valve body 50.

At this time, the treatment liquid is prevented from flowing toward the connecting passage 42 except through the gap 22 by the valve body 50, and therefore the treatment liquid flows in the direction of the connecting passage 42 through the gap 22. Due to the action of gravity, or in other words under the pressure generated by the weight of the treatment liquid itself, the treatment liquid flows into the connecting passage 42 along the first curved surface 44*a* provided over the entire periphery of the opening 44. Furthermore, the treatment liquid flowing through the gap 22 impinges on the second curved surface 51*a* provided on the valve body 50 so as to be led in a direction following the second curved surface 51*a*. Hence, the treatment liquid flows along the first curved surface 44*a* and the second curved surface 51*a* through the gap between the first curved surface 44*a* and the second curved surface 51*a*. As a result, the flow of treatment liquid is led in the direction of the inner wall surface 42*a* of the connecting passage 42.

Further, the radius of curvature of the second curved surface 51*a* is set to be larger than the radius of curvature of the first curved surface 44*a*, and therefore the interval between the first curved surface 44*a* and the second curved surface 51*a* increases toward the downstream side of the treatment liquid. Hence, the treatment liquid gradually spreads out in a center direction of the connecting passage 42 toward the downstream side such that the treatment liquid flowing into the connecting passage 42 from parallel first curved surface portions 44*a* provided on either side at the opening 44 of the connecting passage 42 converges. The treatment liquid therefore flows over the entire flow passage cross-section of the connecting passage 42 such that the air in the connecting passage 42 is pushed out by the treatment liquid in the direction of the slit-shaped opening 41. As a result, air existing in the connecting passage 42 prior to ejection of the treatment liquid is prevented from intermixing with the treatment liquid.

When all of the treatment liquid stored in the storage portion 20 has been ejected, the valve body 50 is driven in a direction approaching the opening 44 of the connecting passage 42, or in other words the first curved surface 44*a*. When the seal 56 provided on the valve body 50 contacts the bottom-wall 43 of the storage portion 20, the valve body 50 stops, and as a result, the bottom-wall 43 of the storage portion 20 and the valve body 50 are sealed. The treatment liquid is then supplied to the storage portion 20, whereupon the process described above is repeated.

The embodiment described in detail above has the following advantages.

The treatment liquid stored in the storage portion 20 is ejected through the slit-shaped opening 41 via the connecting passage 42. Here, the flow of treatment liquid from the storage portion 20 toward the connecting passage 42 is blocked by the valve body 50 provided in the storage portion 20 to cover the flow passage cross-section of the connecting passage 42, and therefore the treatment liquid flows into the connecting passage 42 through the gap 22 between the bottom-wall 43 of the storage portion 20 and the valve body 50. The treatment liquid that flows into the connecting passage 42 flows along the first curved surface 44*a*, which projects to the storage portion 20 side and smoothly connects the surface of the bottom-wall 43 of the storage portion 20 to the inner wall surface 42*a* of the connecting passage 42, and the second curved surface 51*a*, which is provided on the valve body 50 to project to an identical side to the first curved surface 44*a* and oppose the first curved surface 44*a*, through the gap between the first curved surface 44*a* and the second curved surface 51*a*. Therefore, the treatment liquid flow is led in the direction of the inner wall surface 42*a* of the connecting passage 42, and the treatment liquid flow is prevented from separating from the inner wall surface 42*a* of the connecting passage 42. Hence, when the treatment liquid flows into the connecting passage 42 from the storage portion 20, air sandwiched between the treatment liquid flow and the inner wall surface 42*a* of the connecting passage 42 can be prevented from intermingling with the treatment liquid. As a result, air bubbles can be prevented from intermixing with the treatment liquid ejected from the slit-shaped opening 41 without processing to eject the treatment liquid in advance in order to remove air bubbles therefrom is not performed.

The radius of curvature of the second curved surface 51*a* is set to be larger than the radius of curvature of the first curved surface 44*a*, and therefore the second curved surface 51*a* gradually separates from the first curved surface 44*a* toward the downstream side of the treatment liquid. Hence, the treatment liquid flowing along the second curved surface 51*a*, while being led in the direction of the inner wall surface 42*a* of the connecting passage 42, spreads out gradually in a direction heading away from the inner wall surface 42*a* of the connecting passage 42, or in other words in the center direction of the connecting passage 42, toward the downstream side. As a result, unevenness in the flow rate of the treatment liquid in the flow passage cross-section of the connecting passage 42 can be suppressed, and the treatment liquid can be ejected through the slit-shaped opening 41 more evenly.

The length of the second curved surface 51*a* is set to be greater than the length of the first curved surface 44*a* in the treatment liquid flow direction, and therefore the treatment liquid flow can be led in the direction of the inner wall surface 42*a* of the connecting passage 42 by the second curved surface 51*a* over a wider range.

The second curved surface 51*a* is provided to extend further toward the downstream side than the first curved surface 44*a* in the treatment liquid flow direction, and therefore the treatment liquid flowing along the first curved surface 44*a* can be led further downstream in the direction of the inner wall surface 42*a* of the connecting passage 42 by the second curved surface 51*a*.

The bottom-wall 43 of the storage portion 20 and the valve body 50 are capable of relative movement, and on the basis of this relative movement, the gap 22 between the bottom-wall 43 of the storage portion 20 and the valve body 50 can be sealed. Therefore, ejection of the treatment liquid can be stopped even when pressure for causing the treatment liquid to flow into the connecting passage 42 is generated.

When the treatment liquid stored in the storage portion 20 is pressurized and ejected, the pressure of the treatment liquid is distributed, and as a result, the treatment liquid may be ejected from the slit-shaped opening 41 unevenly.

With regard to this point, the connecting passage 42 is connected to the lower portion of the storage portion 20 and the gap 22 between the bottom-wall 43 of the storage portion 20 and the valve body 50 is disposed horizontally, and therefore the pressure generated by the weight of the treatment liquid stored in the storage portion 20 is uniform throughout the gap 22 between the bottom-wall 43 of the storage portion 20 and the valve body 50. Hence, when the treatment liquid is to be ejected from the slit-shaped opening 41 under the pressure generated by the weight of the treatment liquid itself, the treatment liquid can be transmitted to the connecting passage 42 through the gap 22 between the bottom-wall 43 of the storage portion 20 and the valve body 50 at a uniform pressure. As a result, the treatment liquid can be ejected through the slit-shaped opening 41 more evenly.

In particular, all of the treatment liquid stored in the storage portion 20 is ejected through the slit-shaped opening 41, and therefore the treatment liquid can be transmitted to the connecting passage 42 through the gap 22 between the bottom-wall 43 of the storage portion 20 and the valve body 50 at a uniform pressure until ejection of the treatment liquid is complete. Moreover, air bubble generation due to pressure variation in the treatment liquid occurring when ejection of the treatment liquid is halted midway can be avoided.

As described above, the pressure generated by the weight of the treatment liquid stored in the storage portion 20 is uniform throughout the gap 22 between the bottom-wall 43 of the storage portion 20 and the valve body 50, and therefore the treatment liquid can be transmitted to the connecting passage 42 through the gap 22 at a uniform pressure. Here, the first curved surface 44*a* is provided in a loop shape around the inner wall surface 42*a* of the connecting passage 42 having a slit-shaped cross-section, and the gap between the bottom-wall 43 of the storage portion 20 and the valve body 50 is sealed in a loop shape in an equidistant position from the first curved surface 44*a*. Therefore, when the bottom-wall 43 of the storage portion 20 and the valve body 50 move relative to each other such that treatment liquid ejection begins from a condition in which the gap is sealed, the treatment liquid is transmitted evenly to the first curved surface 44*a* from the loop-shaped gap 22. Hence, the treatment liquid flows evenly along the inner wall surface 42*a* of the connecting passage 42, and as a result, the treatment liquid can be ejected through the slit-shaped opening 41 more evenly.

The present invention is not limited to the above embodiment, and may be implemented as follows, for example.

Figure 9A:
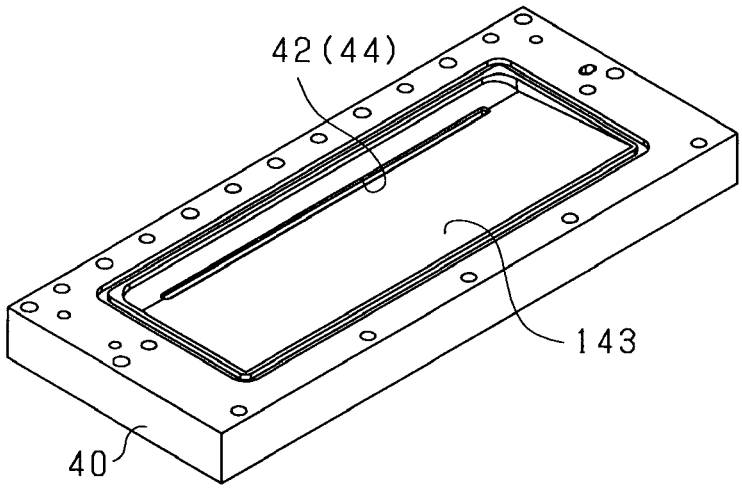
FIG. 9A is a perspective view showing a modified example of the lower wall of the storage portion.
Figure 9B:
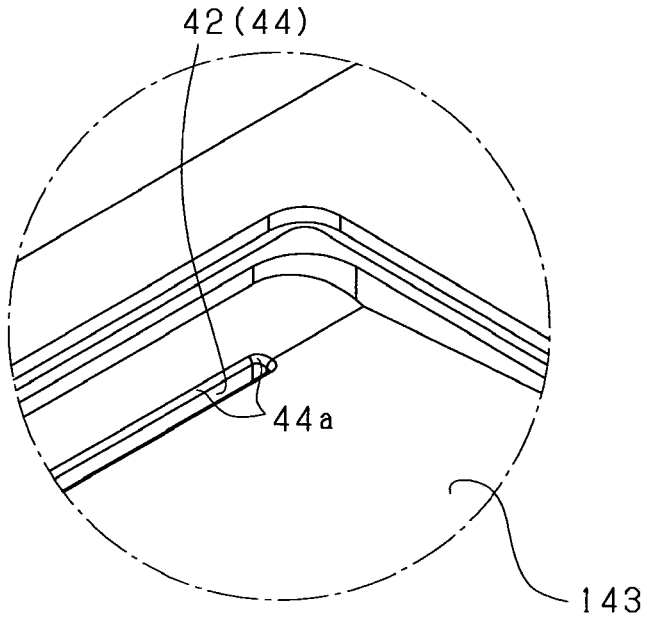
FIG. 9B is an enlarged perspective view of the lower wall of the storage portion and the first curved surface portion.

In the above embodiment, the surface of the bottom-wall 43 to which the connecting passage 42 opens is formed to be flat and disposed horizontally, but as shown in FIGS. 9A and 9B, a surface of a lower wall 143 of the storage portion 20 may be inclined to become gradually lower toward the connecting passage 42. In this case, when the treatment liquid is to be ejected through the slit-shaped opening 41 under the pressure generated by the weight of the treatment liquid itself, the treatment liquid stored in the storage portion 20 is caused to gather in the connecting passage 42 by gravity. As a result, the treatment liquid stored in the storage portion 20 can be ejected fully. Note that a surface of the valve body 50 opposing the surface of the lower wall 143 is preferably inclined in accordance with the incline provided on the surface of the lower wall 143 of the storage portion 20.

In the above embodiment, the seal 56 is provided in a loop shape in an equidistant position from the first curved surface 44*a*, and the valve body 50 seals the bottom-wall 43 of the storage portion 20 and the valve body 50 in a loop shape in an equidistant position from the first curved surface 44*a*. However, the bottom-wall 43 of the storage portion 20 and the valve body 50 do not have to be sealed necessarily in an equidistant position from the first curved surface 44*a*.

In the above embodiment, an amount of treatment liquid used in a single process of the liquid ejecting apparatus is stored in the storage portion 20 such that all of the treatment liquid stored in the storage portion 20 is ejected in a single process. However, the capacity of the storage portion 20 may be increased such that a larger amount of treatment liquid than the amount used in a single process is stored in the storage portion 20 and only a part of the treatment liquid stored in the storage portion 20 is ejected in a single process. In this case, the treatment liquid can be resupplied while treatment liquid remains in the storage portion 20, and therefore air can be prevented from entering through the gap between the bottom-wall 43 of the storage portion 20 and the valve body 50 and so on after the treatment liquid has been ejected. As a result, air bubbles can be prevented from intermixing with the treatment liquid ejected through the slit-shaped opening 41.

In the above embodiment, the treatment liquid is ejected through the slit-shaped opening 41 under the pressure generated by the weight of the treatment liquid itself. In addition thereto, however, the treatment liquid may be pressurized using air or the like.

In the above embodiment, the gap 22 between the bottom-wall 43 of the storage portion 20 and the valve body 50 is disposed horizontally, but the gap 22 may be slightly inclined. Further, in the above embodiment, the connecting passage 42 is disposed to extend in the vertical direction, but the connecting passage 42 may be disposed to extend at a slight incline from the vertical direction.

In the above embodiment, the valve body 50 is driven by the driving portion 70, but a constitution where the bottom-wall 43 of the storage portion 20 and the valve body 50 are moved relative to each other by driving the bottom-wall 43 of the storage portion 20 may be employed instead. Further, the present invention is not limited to a constitution where the gap between the bottom-wall 43 and the valve body 50 is sealed, and instead, a constitution where ejection of the treatment liquid is stopped by a shutoff valve or the like provided in the supply passage for supplying the treatment liquid to the storage portion 20 or the like may be employed. Likewise in this case, the treatment liquid flows along the first curved surface 44*a* and the second curved surface 51*a*, and therefore the treatment liquid flow can be prevented from separating from the inner wall surface 42*a* of the connecting passage 42.

In the above embodiment, the length of the second curved surface 51*a* is set to be greater than the length of the first curved surface 44*a* and the second curved surface 51*a* is provided to extend further toward the downstream side than the first curved surface 44*a* in the treatment liquid flow direction, but it is also possible to employ only one of these constitutions. Further, in this case, the constitution where the radius of curvature of the second curved surface 51*a* is set to be larger than the radius of curvature of the first curved surface 44*a* may be omitted. In other words, these constitutions may be combined as desired as long as at least one of these constitutions is employed.

In the above embodiment, the slit-shaped opening 41 and the cross-section of the connecting passage 42 have an identical shape and identical dimensions, but a constitution including a different connecting passage having a slit-shaped cross-section, such as a constitution where a flow passage sectional area of the connecting passage 42 gradually decreases toward the slit-shaped opening 41 or a constitution where the opening 44 of the connecting passage 42 and the slit-shaped opening 41 are provided non-parallel to each other and connected by a gently curving connecting passage 42, may be employed instead.

In the above embodiment, the short side length (the slit width) of the slit-shaped opening 41 is constant, but a constitution where the short side length (the slit width) partially varies may be employed. Further, the short side length (the slit width) of the slit-shaped opening 41 is set at several mm, but the short side length (the slit width) may be modified as desired. More specifically, the short side length (the slit width) of the slit-shaped opening 41 may be set at several hundred μm.

In the above embodiment, the first curved surface 44*a* is provided around the entire periphery of the opening 44 of the connecting passage 42, while the second curved surface 51*a* is provided to oppose the first curved surface 44*a*, or in other words around an entire periphery of the projecting portion 51 provided on the valve body 50. However, the first curved surface 44*a* and second curved surface 51*a* may be partially omitted. Even in this case, the treatment liquid flow is led in the direction of the inner wall surface 42*a* of the connecting passage 42 in the parts where the first curved surface 44*a* and second curved surface 51*a* are provided, and therefore the air sandwiched between the treatment liquid flow and the inner wall surface 42*a* of the connecting passage 42 can be prevented from intermingling with the treatment liquid.

EXPLANATION OF REFERENCE NUMERALS

20 storage portion
22 gap
41 slit-shaped opening
42 connecting passage
43 lower wall serving as inner wall
44*a* first curved surface
50 valve body serving as flow varying member
51*a* second curved surface

The invention claimed is:

1. A liquid ejecting apparatus comprising:
a storage portion having a storage space for storing a liquid;
a slit-shaped opening for ejecting the liquid;
a connecting passage connecting the storage space to the slit-shaped opening, the connecting passage having a slit-shaped cross section;
a flow varying member provided in the storage space to cover a flow passage cross-section of the connecting passage, the flow varying member forming a gap together with an inner wall of the storage portion so as to allow the liquid to flow into the connecting passage through the gap; and
a first curved surface portion having a convex surface that smoothly connects an inner wall surface of the storage portion to an inner wall surface of the connecting passage,
wherein the flow varying member includes a second curved surface portion facing the first curved surface portion, the second curved surface portion having a concave surface extending along the convex surface of the first curved surface portion.

2. A liquid ejecting apparatus comprising:
a storage portion having a storage space for storing a liquid;
a slit-shaped opening for ejecting the liquid;
a connecting passage connecting the storage space to the slit-shaped opening, the connecting passage having a slit-shaped cross section;
a flow varying member provided in the storage space to cover a flow passage cross-section of the connecting passage, the flow varying member forming a gap together with an inner wall of the storage portion so as to allow the liquid to flow into the connecting passage through the gap; and
a first curved surface portion smoothly connecting an inner wall surface of the storage portion to an inner wall surface of the connecting passage,
wherein the flow varying member includes a second curved surface portion facing the first curved surface portion, the second curved surface portion extending along the first curved surface portion,
and wherein a radius of curvature of the second curved surface portion is larger than a radius of curvature of the first curved surface portion.

3. The liquid ejecting apparatus according to claim 1, wherein a length of the second curved surface portion is greater than a length of the first curved surface portion in a flow direction of the liquid.

4. A liquid ejecting apparatus comprising:
a storage portion having a storage space for storing a liquid;
a slit-shaped opening for ejecting the liquid;
a connecting passage connecting the storage space to the slit-shaped opening, the connecting passage having a slit-shaped cross section;
a flow varying member provided in the storage space to cover a flow passage cross-section of the connecting passage, the flow varying member forming a gap together with an inner wall of the storage portion so as to allow the liquid to flow into the connecting passage through the gap; and
a first curved surface portion smoothly connecting an inner wall surface of the storage portion to an inner wall surface of the connecting passage, wherein the flow varying member includes a second curved surface portion facing the first curved surface portion, the second curved surface portion extending along the first curved surface portion, and wherein the second curved surface portion extends further toward a downstream side than the first curved surface portion in a flow direction of the liquid.

5. The liquid ejecting apparatus according to claim 1, wherein the inner wall of the storage portion and the flow varying member are reciprocally moveable with respect to each other so as to seal the gap between the inner wall of the storage portion and the flow varying member in accordance with the reciprocal movement.

6. The liquid ejecting apparatus according to claim 1, wherein the connecting passage is provided at a bottom of the storage portion, while the gap is disposed horizontally, so as to allow the liquid to be ejected from the slit-shaped opening under a pressure generated by a weight thereof.

7. The liquid ejecting apparatus according to claim 6, wherein the first curved surface portion is provided along the inner wall surface of the connecting passage so as to form a loop, and the inner wall of the storage portion and the flow varying member are reciprocally moveable with respect to each other so as to adjust a width of the gap between the inner wall of the storage portion and the flow varying member, the flow varying member having a seal member provided in a loop shape and configured to seal the gap at an equidistant position from the first curved surface portion.

8. The liquid ejecting apparatus according to claim 6, wherein the inner wall surface of the storage portion is inclined to become gradually lower toward the connecting passage.

9. The liquid ejecting apparatus according to claim 2, wherein a length of the second curved surface portion is greater than a length of the first curved surface portion in a flow direction of the liquid.

10. The liquid ejecting apparatus according to claim 2, wherein the second curved surface portion extends further toward a downstream side than the first curved surface portion in a flow direction of the liquid.

11. The liquid ejecting apparatus according to claim 3, wherein the second curved surface portion extends further toward a downstream side than the first curved surface portion in a flow direction of the liquid.

12. The liquid ejecting apparatus according to claim 9, wherein the second curved surface portion extends further toward a downstream side than the first curved surface portion in a flow direction of the liquid.

13. The liquid ejecting apparatus according to claim 7, wherein the inner wall surface of the storage portion is inclined to become gradually lower toward the connecting passage.

14. The liquid ejecting apparatus according to claim 2, wherein the inner wall of the storage portion and the flow varying member are reciprocally moveable with respect to each other so as to seal the gap between the inner wall of the storage portion and the flow varying member in accordance with the reciprocal movement.

15. The liquid ejecting apparatus according to claim 2, wherein the connecting passage is provided at a bottom of the storage portion, while the gap is disposed horizontally, so as to allow the liquid to be ejected from the slit-shaped opening under a pressure generated by a weight thereof.

16. The liquid ejecting apparatus according to claim 15, wherein the first curved surface portion is provided along the inner wall surface of the connecting passage so as to form a loop, and the inner wall of the storage portion and the flow varying member are reciprocally moveable with respect to each other so as to adjust a width of the gap between the inner wall of the storage portion and the flow varying member, the flow varying member having a seal member provided in a loop shape and configured to seal the gap at an equidistant position from the first curved surface portion.

17. The liquid ejecting apparatus according to claim 15, wherein the inner wall surface of the storage portion is inclined to become gradually lower toward the connecting passage.

18. The liquid ejecting apparatus according to claim 1, wherein the flow varying member further includes:

a projection projecting toward an opening of the connecting passage on the inner wall of the storage portion, the projection extending along the slit-shaped cross section of the connecting passage.

19. The liquid ejecting apparatus according to claim 14, wherein the projection is formed at an end portion of the second curved surface portion extending toward a downstream side in a flow direction of the liquid.

20. The liquid ejecting apparatus according to claim 1, wherein the flow varying member further includes:

a seal member provided in a loop shape, the seal member being configured to seal the gap between the flow varying member and the inner wall of the storage portion by surrounding the first curved surface portion.

* * * * *